US007581376B2

(12) United States Patent
Simmonds

(10) Patent No.: US 7,581,376 B2
(45) Date of Patent: Sep. 1, 2009

(54) SPUN YARN, AND METHOD AND APPARATUS FOR THE MANUFACTURE THEREOF

(75) Inventor: Glen E. Simmonds, Avondale, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 11/065,495

(22) Filed: Feb. 24, 2005

(65) Prior Publication Data

US 2005/0188672 A1 Sep. 1, 2005

Related U.S. Application Data

(60) Provisional application No. 60/548,432, filed on Feb. 27, 2004.

(51) Int. Cl.
*D02G 3/02* (2006.01)
*D02G 3/22* (2006.01)

(52) U.S. Cl. ..... 57/350; 57/333

(58) Field of Classification Search ..... 57/333, 57/350

See application file for complete search history.

(56) References Cited

U.S. PATENT DOCUMENTS

| | | | | |
|---|---|---|---|---|
| 2,721,440 | A | 10/1955 | New et al. | |
| 2,784,458 | A | 3/1957 | Preston et al. | |
| 3,110,151 | A | 11/1963 | Bunting, Jr. et al. | |
| 3,469,285 | A | 9/1969 | Garrison | |
| 3,577,873 | A | 5/1971 | Waters | |
| 3,824,776 | A | 7/1974 | London, Jr. | |
| 3,945,188 | A | 3/1976 | Muller | |
| 4,080,778 | A | 3/1978 | Adams et al. | |
| 4,080,788 | A | 3/1978 | Kantz | |
| 4,118,921 | A | 10/1978 | Adams | |
| 4,356,690 | A | 11/1982 | Minorikawa et al. | |
| RE31,376 | E * | 9/1983 | Sheehan et al. | 57/208 |
| 4,403,470 | A | 9/1983 | Nelson | |
| 4,434,530 | A | 3/1984 | Miessen | |
| 4,497,167 | A * | 2/1985 | Nakahara et al. | 57/328 |
| 4,547,933 | A | 10/1985 | Lauterbach | |
| 4,667,463 | A | 5/1987 | Minorikawa et al. | |
| 4,736,578 | A | 4/1988 | Shaffer | |
| 4,768,336 | A * | 9/1988 | Stahlecker et al. | 57/328 |
| 4,825,633 | A | 5/1989 | Artzt | |
| 4,856,147 | A | 8/1989 | Armiger | |
| 4,924,556 | A | 5/1990 | Gilhaus | |
| 4,965,919 | A * | 10/1990 | Fujita et al. | 28/220 |
| 5,006,294 | A | 4/1991 | Bice | |
| 5,048,281 | A | 9/1991 | Dallmann | |
| 5,195,313 | A * | 3/1993 | Coons, III | 57/264 |

(Continued)

FOREIGN PATENT DOCUMENTS

| | | |
|---|---|---|
| DE | 26 28 774 | 11/1977 |

(Continued)

OTHER PUBLICATIONS

U.S. Appl. No. 09/979,808, filed Nov. 21, 2001, Perrotto et al.

(Continued)

*Primary Examiner*—Shaun R Hurley

(57) ABSTRACT

The present invention relates to a novel spun yarn, and a method and apparatus for the manufacture thereof.

15 Claims, 3 Drawing Sheets

U.S. PATENT DOCUMENTS

| | | | | |
|---|---|---|---|---|
| 5,481,863 | A * | 1/1996 | Ota | 57/328 |
| 5,497,608 | A | 3/1996 | Matsumoto | |
| 5,640,745 | A | 6/1997 | Bertsch et al. | |
| 5,736,243 | A | 4/1998 | Aneja | |
| 6,052,878 | A | 4/2000 | Allred et al. | |
| 6,438,934 | B1 * | 8/2002 | Foster et al. | 57/328 |
| 6,513,315 | B1 * | 2/2003 | Alavoine et al. | 57/286 |
| 6,606,846 | B2 * | 8/2003 | Land | 57/5 |
| 6,701,704 | B2 * | 3/2004 | Foster et al. | 57/333 |
| 7,083,853 | B2 | 8/2006 | Simmonds et al. | |
| 7,100,246 | B1 | 9/2006 | Perrotto | |
| 7,267,871 | B2 | 9/2007 | Perrotto et al. | |
| 2004/0081825 | A1 * | 4/2004 | Perrotto et al. | 428/373 |
| 2005/0147815 | A1 * | 7/2005 | Perrotto et al. | 428/364 |
| 2006/0009873 | A1 | 1/2006 | Scott et al. | |
| 2006/0150372 | A1 | 7/2006 | Popper et al. | |
| 2006/0165982 | A1 | 7/2006 | Simmonds | |

FOREIGN PATENT DOCUMENTS

| | | | |
|---|---|---|---|
| DE | 39 26 930 | A1 | 2/1991 |
| EP | 0 122 949 | | 10/1984 |
| EP | 0 532 458 | B1 | 9/1996 |
| EP | 0811 711 | A2 | 12/1997 |
| GB | 843 283 | | 8/1960 |
| GB | 924 086 | | 4/1963 |
| GB | 924088 | | 4/1963 |
| GB | 1 058 551 | | 2/1967 |
| GB | 2 321 651 | | 8/1998 |
| JP | 54-125724 | | 9/1979 |
| JP | 04091243 | | 3/1992 |
| WO | WO 1985000393 | A1 | 1/1985 |
| WO | WO 98/48088 | | 10/1998 |
| WO | WO 03/29539 | | 4/2003 |
| WO | WO 03/50336 | | 6/2003 |

OTHER PUBLICATIONS

P. Grosberg et al. The Insertion of 'Twist' Into Yarns by Means of Air-Jets Part 1: An Experimental Study of Air-Jet Spinning, Journal of Textile Institute, 1987, pp. 189-219.

* cited by examiner

SPUN YARN, AND METHOD AND APPARATUS FOR THE MANUFACTURE THEREOF

This application claims the benefit of U.S. Provisional Application No. 60/548,432, filed on Feb. 27, 2004, which is incorporated in its entirety as a part hereof for all purposes.

FIELD OF THE INVENTION

The present invention relates to a spun yarn and a method and apparatus for the manufacture thereof.

BACKGROUND OF THE INVENTION

Spun yarns, which are those made up of synthetic or natural staple fibers, are easily recognized as yarns possessing fiber ends protruding from the surface of the yarn. They are further recognized as being either twisted or fasciated in structure. A twisted yarn, typically manufactured by ring spinning, possesses torque or twist liveliness. A twisted yarn that has twist liveliness, when held by both ends, will spontaneously curl around itself. A close examination of the yarn reveals that the fibers are held together in a helical pattern.

Fasciated yarns are recognized as yarns without twist liveliness and are typically manufactured by open-end rotor spinning or air jet spinning. A close examination of these yarns reveals a longitudinally well-ordered bundle of fibers that are in substantially parallel alignment with the bundle being wrapped by fibers that wind around surface of the bundle.

The orientation of the surface wrapping fibers is different for fasciated open-end yarns and fasciated air jet spun yarns. Air jet spun yarns typically possess wrapping fibers that are predominantly helically wrapped in one direction around the bundle of substantially parallel fibers. The wrapping fibers of open-end spun yarns tend to be more random with the direction and angle of wrapping being different for different fibers. A non-fasciated segment of a yarn has no, or at most an insignificant number of, surface wrapping fibers.

The widely accepted method of producing air jet spun yarns is with a pair of torque jets in series, which imposes false twist to the yarn in opposing directions. A sliver passes into a cylindrical yarn cavity of the body of an air jet for consolidation therein to form a yarn. The torque jets provide air inlet bores impinging on the yarn cavity such that there is an offset between the axis of the air inlet bore and the center line of the yarn cavity. Because of this offset, the air from the air inlet bore impinges the yarn tangentially and imparts torque to the yarn. False twist is a temporary twist imparted to the yarn or sliver on the inlet side of a twisting jet, such as the torque jet described above.

Continuous filament yarns are easily recognized by the absence of fiber ends protruding from the surface of the yarn. One of the many common structures of continuous filament yarns are interlaced yarns. These yarns are noted for their repeating pattern of tight nodes, or interlace points, separated by open segments of parallel filaments which are not held together by looped or wrapping fibers. Typical interlace points are characterized by a random tangling of fibers which form a structure such as a knot in which the fibers are snarled or randomly entangled or laced together, as shown in FIG. 2. The tightness and spacing of the interlace points and open segments are the subject of many variations that are manufactured using interlacing jets of many designs. Typically, there are also no fiber ends protruding from the surface of interlaced yarns unless they are post treated with an abrading technique. The process of air jet texturizing of continuous filament yarns is greatly enhanced by wetting the yarn before it enters the interlacing jet. Many devices exist to provide the wetting function such as metered slot applicators, gravity fed slot applicators, and spraying devices. This method, however, is not currently known or practiced in the production of spun yarns.

A need remains to produce yarns having elongation and tenacity properties similar to those of interlaced continuous filament yarns but exceeding those of spun yarns made by conventional spinning equipment, and that need is addressed by the method, apparatus and yarn of this invention.

SUMMARY OF THE INVENTION

One embodiment of this invention is a method for spinning a yarn by (a) passing a sliver through a torque jet that imparts rotation to the fibers of the sliver, and forms a partially consolidated yarn, and (b) passing the partially consolidated yarn through an interlace jet to form a consolidated yarn.

Another embodiment of this invention is an apparatus for spinning a yarn from a sliver that includes (a) a torque jet that forms the sliver into a partially consolidated yarn having a false twist, and (b) an interlace jet positioned at a distance downstream from the torque jet such that the partially consolidated yarn, when received into the interlace jet, retains false twist.

A further embodiment of this invention is a yarn that includes a plurality of first and second segments wherein (a) each first segment comprises a longitudinally well-ordered bundle of discontinuous fibers that are in substantially parallel alignment, and the longitudinally well-ordered bundle is wrapped with at least one surface fiber that passes around the bundle with a frequency such that the distance between turns of the wrapping fiber is less than about 100 times the largest dimension of the cross section of the wrapping fiber; and (b) each second segment comprises a bundle of discontinuous fibers that is not wrapped by a surface fiber, or is wrapped by a surface fiber that passes around the bundle with a frequency such that the distance between turns of the wrapping fiber is about 100 or more times the largest dimension of the cross section of the wrapping fiber.

Yet another embodiment of this invention is a yarn that includes a plurality of first and second segments wherein (a) each first segment comprises (i) a longitudinally well-ordered bundle of discontinuous fibers that are in substantially parallel alignment, and (ii) one or more fibers that wrap around the surface of that bundle; and (b) each second segment comprises one or more knots; and wherein, in a length of the yarn, the lengths of the first segments added together comprise more than fifty percent of the length of yarn, and the lengths of the second segments added together comprise less than fifty percent of the length of yarn.

DETAILED DESCRIPTION OF THE INVENTION

Figure 1:
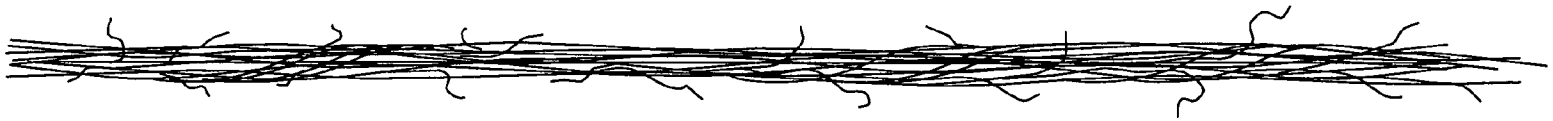
FIG. 1 is an illustration of a yarn that has been prepared by passage through only a first torque jet followed by a second torque jet of the opposite direction.

The present invention provides a novel yarn structure, and a method and apparatus to produce same by the use of a novel combination of air jet entanglement devices, some or all of which may be conventional air jet entanglement devices.

A fiber is a cylindrical-shaped unit of matter characterized by a length at least 100 times its diameter or width that is capable of being spun into a yarn, or made into a fabric, by various methods such as weaving, knitting, braiding, felting and twisting. For processing on textile machinery, a fiber of the correct length (such as about 1~8 inches) is needed. A staple fiber has the correct length for such purpose because it is either a natural fiber, and inherently has a useful length, or it is a discontinuous length of a continuous synthetic filament that has been cut to the correct length. A continuous filament may thus be thought of as a fiber of an indefinite or extreme length, which is distinguished from a staple fiber in respect of its having not been cut to machine length.

A yarn is a continuous strand of textile fibers and/or filaments in a form in which the fibers and/or filaments are consolidated, and thus sufficiently intermingled that the yarn has an integrity and unity of construction suitable for knitting, weaving, or otherwise intertwining, to form a fabric. A sliver is a bundle of fibers in which the fibers are not consolidated, and thus do not have an integrity and unity of construction suitable for operations such as knitting or weaving, but is a common feed stock from which a fiber, and ultimately a yarn, is prepared.

In the method of this invention, a sliver of unconsolidated staple fibers is fed into a first air entanglement device, which may be a torque air jet that imposes a false twist on the staple fibers in the sliver. The staple fibers in the sliver may be any natural and/or synthetic fiber that has an average fiber length longer than about 6 inches.

The fibers emerging from the torque air jet form a partially consolidated yarn, and are characterized by having been formed into a plurality of longitudinally well-ordered bundles in which the fibers are substantially parallel. The condition of being substantially parallel includes the condition in which the fibers are actually parallel. A bundle of fibers is longitudinally well-ordered when the fibers in the bundle are efficiently and relatively-closely packed such that greater than forty, preferably greater than sixty, more preferably greater than eighty, and most preferably greater than ninety percent of the volume of the bundle is occupied by the fibers. The fibers in a bundle are substantially parallel when, as compared to the longitudinal axis of the bundle, fewer than ninety, preferably fewer than eighty, more preferably fewer than sixty, and most preferably fewer than forty percent of the fibers have sections form an angle of thirty degrees or more with the axis of the bundle.

The partially consolidated yarn is then passed through a further air entanglement device, such as an interlace jet. In a preferred embodiment, the consolidated yarn emerging from the interlace jet is passed through an additional torque jet in which the direction of twist is the same as the first torque air jet. As a result of this combination of jets, in the fascinated segments of the yarn, some of the staple fibers are wrapped around the surface of the rotating, false twisted fibers in the segment of the yarn where the bundle of fibers is longitudinally well-ordered and where the fibers are substantially parallel.

A yarn that has passed through only a torque air jet is illustrated in FIG. 1, wherein it may be seen that there is a longitudinally well-ordered bundle of fibers that are in substantially parallel alignment, and the bundle is wrapped by fibers that wind around surface of the bundle. The wrapping fibers pass around the bundle with a relatively low frequency, however, such that the distance between turns of the wrapping fiber is about 100 or more times the largest dimension of the cross section of the wrapping fiber.

Figure 3:
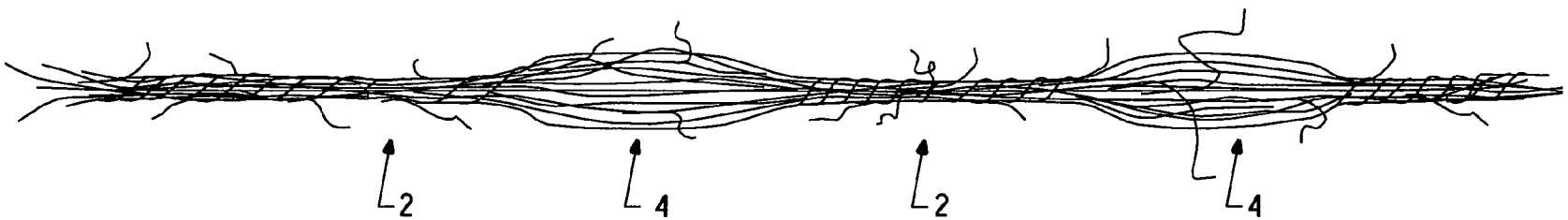
FIG. 3 is an illustration of a yarn that has been prepared by passage through a torque jet followed by an interlace jet.

A yarn that has passed through a torque air jet followed by an interlace jet is illustrated in FIG. 3. In FIG. 3, it may be seen that, in the fasciated segments 2 of the yarn, the fibers of the yarn are in a longitudinally well-ordered bundle and are substantially parallel, and the longitudinally well-ordered bundle is wrapped with a surface fiber that passes around the bundle with a relatively high frequency such that the distance between turns of the wrapping fiber is less than about 100, preferably less than about 60, more preferably less than about 30, and most preferably less than about 15 times the largest dimension of the cross section of the wrapping fiber. The non-fasciated segments 4 of the yarn are also shown in FIG. 3. In these open segments, the bundle of fibers is not longitudinally well-ordered, and has been expanded to form a balloon in which a relatively small percentage of the volume of the bundle is made up of the fibers. Protruding fiber ends may be present in both the fasciated segments 2 as well as the non-fasciated segments 4 of the yarn.

Figure 4:
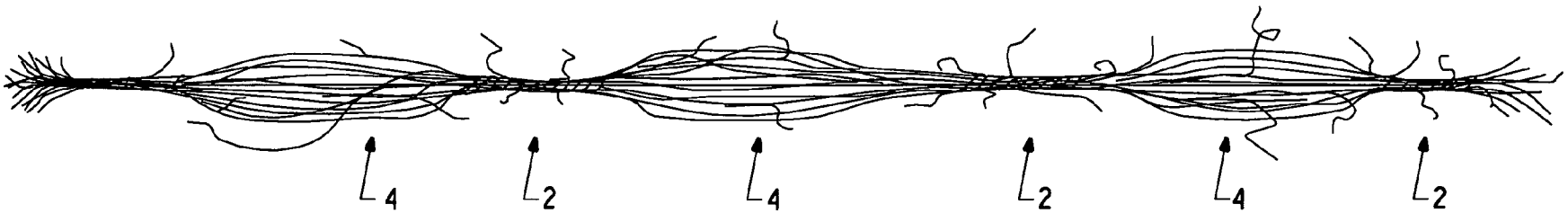
FIG. 4 is an illustration of a yarn that has been prepared by passage through a torque jet followed by an interlace jet followed by a second torque jet.
Figure 5:
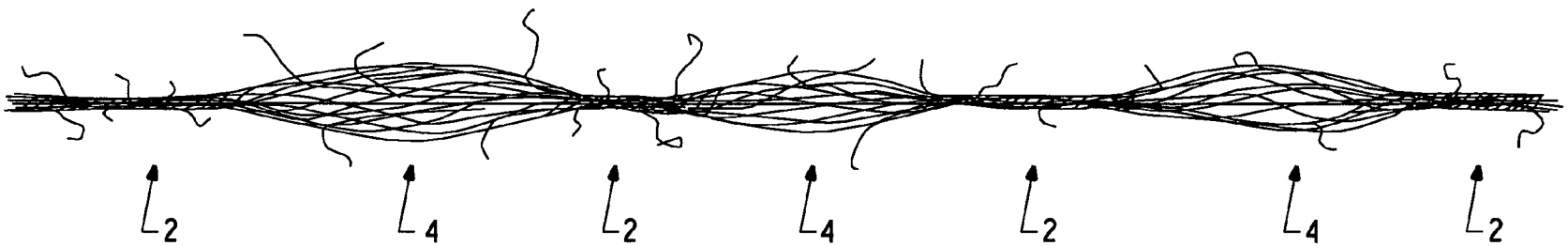
FIG. 5 is an illustration of a yarn that has been prepared by passage through a torque jet followed by an interlace jet followed by a forwarding torque jet.

A yarn that has passed through a torque air jet followed by an interlace jet followed by a second torque jet is illustrated in FIGS. 4 and 5, wherein the second torque jet used to make the yarn of FIG. 5 is a forwarding torque jet. Fasciated segments 2, and non-fasciated segments 4, may also be seen in the yarns shown respectively in FIGS. 4 and 5.

The yarn of this invention is made up primarily of discontinuous staple fibers, and possesses both protruding fiber ends and fascinated segments. A careful examination of the fasciated segments reveals that they have, in general, a longitudinally well-ordered bundle of substantially parallel fibers wrapped by surface fibers much like those found in an air jet spun yarn rather than the randomly-entangled bundles of fibers typically found in continuous filament yarns. Typically the fasciated segments may be about 1 to about 40 mm, or about 1 to about 30 mm, in length. The fasciated segments are separated by non-fasciated segments of the yarn where no wrapping fibers are present, and these non-fasciated segments can be made shorter, equivalent or longer in length than the interlaced segments, by an amount in the range of from about 1 mm to about 15 mm. The length and spacing of the fasciated segments can be modified according to the spacing of the air jets in the spinning apparatus, and according to the amount air pressure applied to the jets. A greater amount of air pressure will be needed to impart a selected amount of twist to a fiber prepared from a polymer having a higher bending modulus than a polymer having a lower bending modulus, and, when the fibers are run a higher speed, a greater amount of air pressure will be needed to impart a selected amount of twist than when the fibers are run at a lower speed.

One embodiment of this invention may, for example, be a yarn that includes a plurality of first and second segments wherein (a) each first segment comprises a longitudinally well-ordered bundle of discontinuous fibers that are in substantially parallel alignment, and the longitudinally well-ordered bundle is wrapped with at least one surface fiber that passes around the bundle with a frequency such that the distance between turns of the wrapping fiber is less than about 100 times the largest dimension of the cross section of the wrapping fiber; and (b) each second segment comprises a bundle of discontinuous fibers that is not wrapped by a surface fiber, or is wrapped by a surface fiber that passes around the bundle with a frequency such that the distance between turns of the wrapping fiber is about 100 or more times the largest dimension of the cross section of the wrapping fiber. The first and second segments may alternate, or be randomly scattered along the length of the yarn. In a preferred embodiment, in a length of the yarn, the lengths of the first segments added together may be greater than fifty percent, preferably greater than sixty percent, more preferably greater than eighty percent, and most preferably greater than ninety percent of the length of yarn; and the lengths of the second segments added together may be less than fifty percent, preferably less than forty percent, more preferably less than twenty percent, and most preferably less than ten percent of the length of yarn.

Figure 2:
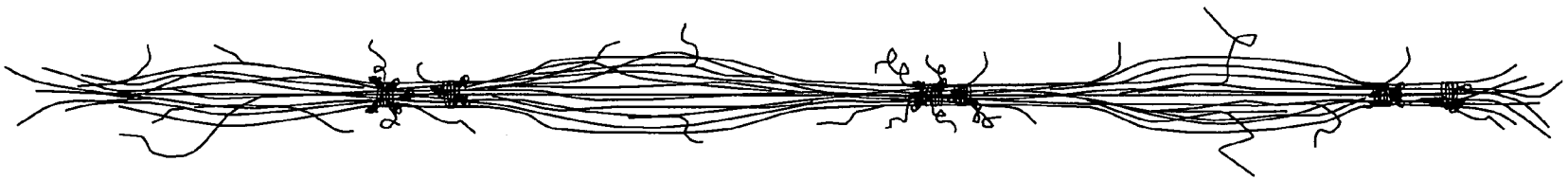
FIG. 2 is an illustration of a yarn that has been prepared by passage through an interlace jet only.

As the method and apparatus of this invention will reduce the occurrence of knots in a yarn made thereby, such as shown in FIG. 2, a further alternative embodiment of this invention is a yarn that includes a plurality of first and second segments wherein (a) each first segment comprises (i) a longitudinally well-ordered bundle of discontinuous fibers that are in substantially parallel alignment, and (ii) one or more fibers that wrap around the surface of that bundle; and (b) each second segment comprises one or more knots; and wherein, in a length of the yarn, the lengths of the first segments added together comprise greater than fifty percent, preferably greater than sixty percent, more preferably greater than eighty percent, and most preferably greater than ninety percent of the length of yarn, and the lengths of the second segments added together comprise less than fifty percent, preferably less than forty percent, more preferably less than twenty percent, and most preferably less than ten percent of the length of yarn.

The yarns of this invention may also include some continuous filament fibers in addition to the discontinuous staple fibers as described above. The character of the consolidated yarn is not grossly affected by the incorporation of the continuous filaments. Continuous filament fibers may be used in an amount of up to about 50 wt % of the fibers of the yarn, and preferably in an amount of about 5 to about 30 wt %, and more preferably in an amount of about 10 to about 25 wt %.

The yarn of this invention may be made from a fiber prepared from materials selected from the group consisting of nylon, polyester, an aramid (a polymer derived for example from m- or p-phenylenediamine and terephthaloyl chloride), a fluoropolymer, an acetate polymer or copolymer, an acrylic polymer or copolymer, polyacetal, an acrylate polymer or copolymer, polyacrylonitrile, a cellulose polymer, an olefin polymer or copolymer (such as an ethylene or propylene polymer or copolymer), polyimide, a styrenic polymer or copolymer (including for example, styrene/acrylonitrile), an ether/ester copolymer, a copolymer of an amide with an ether and/or ester, a vinyl polymer such as poly(vinyl chloride) or poly(vinyl alcohol), and a polyimide; and mixtures of any two or more thereof. Preferred choices for the fiber, if it is to be drawn, may include, for example, nylon, polyester, an olefin polymer or copolymer (such as an ethylene or propylene polymer or copolymer), an ether/ester copolymer, an acrylic polymer or copolymer, polyacetal, poly(vinyl chloride), and mixtures of any two or more thereof.

If continuous filaments are used to prepare the yarn of this invention in addition to discontinuous fibers, they may be filaments prepared from materials selected from the group consisting of nylon, polyester, an aramid (a polymer derived for example from m- or p-phenylenediamine and terephthaloyl chloride), a fluoropolymer, an acetate polymer or copolymer, an acrylic polymer or copolymer, polyacetal, an acrylate polymer or copolymer, polyacrylonitrile, a cellulose polymer, an olefin polymer or copolymer (such as an ethylene or propylene polymer or copolymer), polyimide, a styrenic polymer or copolymer (including for example, styrene/acrylonitrile), an ether/ester copolymer, a copolymer of an amide with an ether and/or ester, a vinyl polymer such as poly(vinyl chloride) or poly(vinyl alcohol), and a polyimide a polyurethane, a copolymer having blocks of polyurethane and blocks of polymerized ethers and/or esters, or elastane. These continuous filaments may be combined with other materials as described above or with a natural fibers such as cotton or wool, a metallic fiber or wire (such as steel or copper), a glass fiber or a ceramic fiber; and mixtures of any two or more thereof.

In a preferred embodiment, the yarn of this invention may be prepared from a fiber that may be an aramid fiber, or it can be a filament with high elasticity, such as a spandex-type fiber or a 2GT (1,2-ethane diol (or ethylene glycol) estrified with terephthalic acid) or a 3GT (1,3-propanediol (or 1,3 propylene glycol)-3GT (estrified with terephthalic acid) polyester fiber. A preferred spandex-type fiber is one with elastic filaments having an elongation to break greater than about 100% and an elastic recovery of at least 30% from an extension of about 50%. This may, for example, be a copolymer having blocks of polyurethane and blocks of polymerized ethers and/or esters. The fibers as described above can be added to other fibers that preferably include a polymer such as nylon, polyester, aramid, fluoropolymer or Nomex® (brand name for a fiber and paper with raw materials of isophthalyl chloride, methpenylene diamine). Kevlar® aramid fiber of continuous filaments has been combined with polyester in one product; and Lycra® elastic fiber of continuous filaments has been combined with polyester in another product.

The yarn of this invention exhibits superior strength, superior variability of strength, and good mass uniformity when compared to a yarn spun from an equivalent sliver via a conventional air jet spinning system of two torque jets that provide to the yarn false twist in opposing directions.

Operation of the method of this invention begins with a sliver of staple fibers. The sliver may be natural fibers made by known types of carding and straightening steps, or may be made by a stretch-breaking synthetic filaments by a process such as disclosed in U.S. Pat. No. 4,080,788 or in U.S. application Ser. No. 09/979,808, filed Nov. 21, 2001, each of which is incorporated in its entirety as a part hereof for all purposes. In a stretch-break process, continuous filaments are stretched and ultimately broken into sections useful for being intermingled into fibers and ultimately a yarn by gripping the filaments between two sets of rollers, the second of which is running at a faster speed than the first.

The staple fibers in the sliver have a range of lengths rather than being of fixed cut length. The average fiber length is equal to or longer than the length of those fibers commonly known as long staple fibers. The average length of the staple fibers suitable for use in the method of this invention is approximately 6 inches or greater.

Figure 6:
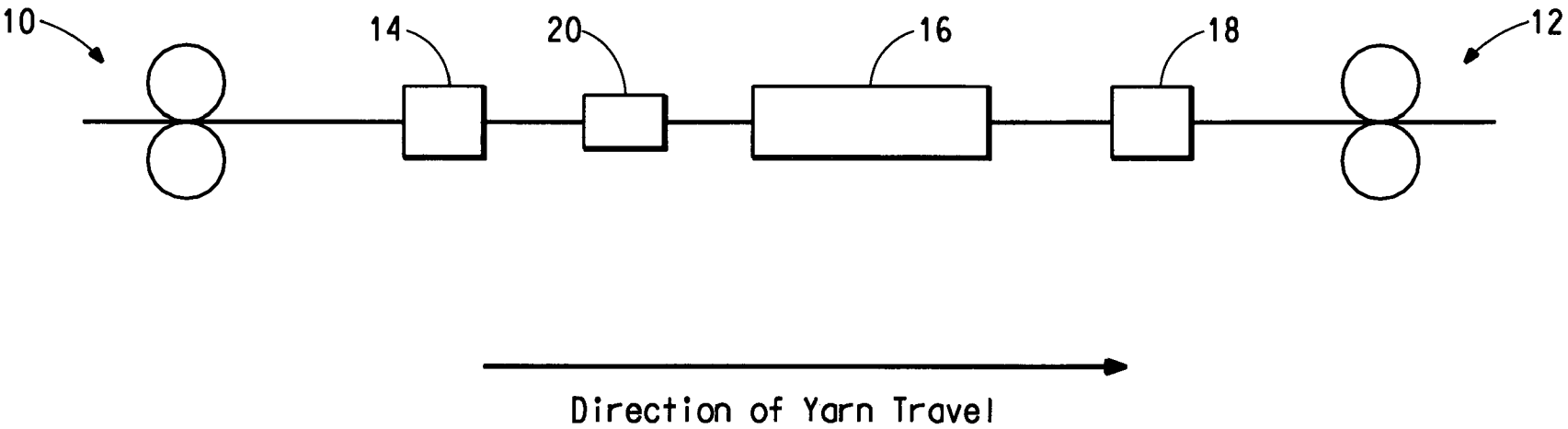
FIG. 6 is a diagram of the arrangement of the components of a spinning apparatus of this invention.

The sliver is directly fed into a spinning machine that will include the spinning apparatus of this invention. A diagram of the arrangement of the components of a spinning apparatus of this invention is shown in FIG. 6. In FIG. 6, it may be seen that the apparatus includes a first pair of moving rolls 10, a second pair of moving rolls 12, a first torque jet 14, an interlace jet 16, and an optional second torque jet 18. The direction of yarn travel is shown by the arrow, with the arrow pointing downstream. The sliver enters the first set of moving rolls 10. The speeds of the first and second pairs of moving rolls 10, 12 can vary so that the sliver is either overfed, equally fed or underfed by varying the speed ratio of the second pair of rolls 12 to the first pair of rolls 10 between about 0.8 to about 1.1. The air jets 14, 16, and optional jet 18, which consolidate the fibers, are typically located in the zone between the rolls.

The sliver enters the first pair of rolls 10 and passes to torque jet 14. The false twist imparted to the sliver by the torque jet 14 extends upstream from jet 14. The yarn is fully formed after its passage through the interlace jet 16 and possesses at that point both false twist and surface wrapping. If the second, optional torque jet is used, it may have for example the same air direction as the first torque jet 14. Before the yarn reaches the second set of rollers 12, the false twist comes out of the yarn. After the yarn exits the second set of rollers 12, it is consolidated and ready for winding.

In the apparatus, the interlace jet is positioned at a distance downstream from the torque jet such that the partially consolidated yarn, when received into the interlace jet, retains false twist. The length of this distance will be determined for each system be a variety of factors including, for example, the speed of the fibers and the weight of the fibers. When the fibers from which the yarn is being prepared are being run at a higher speed, the interlace jet will have to be closer to the torque jet because there will not be as much time for the torque jet to impart false twist to the partially consolidated yarn. When a heavier fiber is being used to prepare the yarn, the interlace jet will again need to be closer to the torque jet because it is more difficult to impart false twist to a heavier yarn. It is desired to retain as much false twist as possible in the partially consolidated yarn as it is passed into the interlace jet because that will increase the tendency to obtain from the interlace jet a yarn with good wrapping of surface fibers and reduce the tendency to obtain a yarn containing knots instead of surface wrapping.

In one alternative embodiment, the sliver, or partially consolidated yarn, is passed through a wetting device 20 prior to being passed through an interlace jet. The wetting device may be located either between the torque jet (or first torque jet if they are two or more) and the interlace jet, or upstream from the (first) torque jet. The wetting device may, for example, be any of the devices known for use in air jet texturizing for this purpose, such as a metered slot applicator, a gravity fed slot applicator, or a spraying device. The wetting liquid may be water or a fiber finish.

Interlace jets typically have one or more air impingement inlets entering the yarn cavity. The stream of air exiting the inlets into the yarn cavity creates turbulence that serves to entangle the yarn. A design of a suitable interlace jet is described in U.S. Pat. No. 6,052,878, which is incorporated in its entirety as a part hereof for all purposes, but other conventional interlace jets may be used as well. The interlace jet may also have forwarding, i.e. aspirating, flow to the air stream.

One or both of the air torque jets may have forwarding, i.e. aspirating, flow to the air vortex in the yarn cavity of the jet. This may be accomplished by angling the air inlets so that the air flow through the jet yarn cavity is in the same direction as yarn travel. Also, the ratio of the entrance to exit diameter of the yarn cavity may be sized such that the air flow out of the yarn cavity is in the same direction as the travel of the yarn through the jet. Typical torque jets are described in EP 532,458 and EP 811,711, each of which is incorporated in its entirety as a part hereof for all purposes. In a typical torque jet, for example, the fibers of a false twisted textile yarn are intermingled to increase their cohesion, and the residual torque in the yarn is reduced, by forwarding the yarn along a yarn path through a duct in a nozzle body, and directing a fluid flow into the duct transversely of the yarn path with the yarn path centrally disposed relative to the fluid flow to intermingle the filaments and simultaneously directing the fluid flow to swirl around the yam path to reduce the residual torque. This is achieved by directing two fluid flows in opposed, overlapping directions but offset relative to each other, or by directing the fluid flow towards a base surface of the duct which is planar and inclined laterally of the duct out of the perpendicular to the direction of fluid flow. A yarn threading slot extends longitudinally of the body and communicates with the duct and the exterior of the body. The slot has a curved profile between the duct and an enlarged inlet at the exterior of the body.

The advantageous effects of this invention are demonstrated by a series of examples, as described below. The embodiments of the invention on which the examples are based are illustrative only, and do not limit the scope of the invention. The significance of the examples is better understood by comparing the results obtained from these embodiments of the invention with the results obtained from certain formulations arrangements that are designed to serve as controlled experiments since they do not possess the distinguishing features of this invention.

EXAMPLES

Example 1

A sliver of staple fibers was created by drawing and stretch-breaking 3 ends of polyester microfiber partially-oriented yarn ("POY") of 255 denier and 200 fibers in each end. The POY was passed through a device with the following speed ratios:

Draw zone speed ratio 2:1

Stretch-break speed ratio 3:1

The incoming speed of the POY was 44 yards per minute.

The sliver was then directly fed into a yarn consolidation zone with a speed ratio of 0.97:1. Within the consolidation zone were one S-direction torque jet, followed by an interlace jet, followed by another S-direction torque jet. The air pressures supplied to the jets were 40 psi, 110 psi and 30 psi respectively.

The resultant consolidated yarn was 131 denier. The exit speed from the machine was 256 yards per minute.

Mass uniformity was measured off-line by standard methods using a Uster UT-3 device. The mass uniformity of the yarn was 11.00.

Yarn elongation and tenacity were measured off-line by standard methods using a Uster Tensojet device set to 500 breaks. The resultant properties were:

| | |
|---|---|
| Average elongation: | 7.88% |
| CV % of elongation: | 9.01% |
| Maximum elongation: | 9.98% |
| Minimum elongation: | 5.23% |
| Average tenacity: | 37.19 cN/tex |
| CV % of tenacity: | 11.65% |
| Maximum tenacity: | 50.16 cN/tex |
| Minimum tenacity: | 22.23 cN/tex |

The following examples were examined visually for difference in appearance and yarn structure. A 20" length of yarn was chosen at random and examined for the number of interlaced segments and the sizes of both the fasciated segments and the non-fasciated (i.e. non-wrapped) segments.

Example 2

A sliver of staple fibers was created by drawing and stretch-breaking 3 ends of polyester microfiber POY of 255 denier and 200 fibers in each end. The POY was passed through a device with the following speed ratios:

Draw zone speed ratio 2:1

Stretch-break speed ratio 3:1

The incoming speed of the POY was 10 yards per minute.

The sliver was then directly fed into a yarn consolidation zone with a speed ratio of 0.80:1. Within the consolidation zone was one forwarding torque jet followed by an interlace jet of the type described in U.S. Pat. No. 6,052,878. The air pressure supplied to both jets was 110 psi.

The resultant consolidated yarn was 159 denier. The exit speed from the machine was 48 yards per minute.

In a 20 inch length of yarn there were 28 interlaced segments comprised primarily of parallel fibers fasciated with fibers wrapped in a helical manner to the yarn axis. The fasciated yarn segments ranged in length from 12 mm to 37 mm. The non-fasciated segments ranged in length from 3 mm to 11 mm.

Example 3

A sliver of staple fibers was created by drawing and stretch-breaking 3 ends of polyester microfiber POY of 255 denier and 200 fibers in each end. The POY was passed through a device with the following speed ratios:

Draw zone speed ratio 2:1

Stretch-break speed ratio 3:1

The incoming speed of the POY was 44 yards per minute.

The sliver was then directly fed into a yarn consolidation zone with a speed ratio of 0.80:1. Within the consolidation zone was one torque jet, followed by an interlace jet of the type described in U.S. Pat. No. 6,052,878, followed by a forwarding torque jet. The air pressure supplied to the jets was 40 psi, 110 psi and 110 psi respectively.

The resultant consolidated yarn was 159 denier. The exit speed from the machine was 211 yards per minute.

In a 20 inch length of yarn there were 74 interlaced segments comprised primarily of parallel fibers fasciated with fibers wrapped in a helical manner to the yarn axis. The fasciated yarn segments ranged in length from 1 mm to 7 mm. The non-fasciated segments ranged in length from 3 mm to 13 mm.

Example 4

A yarn was made according to the parameters of Example 1.

In a 20 inch length of yarn there were 68 interlaced segments comprised primarily of parallel fibers fasciated with fibers wrapped in a helical manner to the yarn axis. The fasciated yarn segments ranged in length from 1 mm to 8 mm. The non-fasciated segments ranged in length from 1 mm to 8 mm.

Control A

A sliver of staple fibers was created by drawing and stretch-breaking 3 ends of polyester microfiber POY of 255 denier and 200 fibers in each end. The POY was passed through a device with the following speed ratios:

Draw zone speed ratio 2:1

Stretch-break speed ratio 3:1

The incoming speed of the POY was 18.9 yards per minute.

The sliver was then directly fed into a yarn consolidation zone with a speed ratio of 0.97:1. Within the consolidation zone were one S-direction torque jet, followed by a Z-direction torque jet as is typical in air jet spinning. The air pressures supplied to the jets were 55 psi and 70 psi respectively.

The resultant consolidated yarn was 131 denier. The exit speed from the machine was 110 yards per minute.

Mass uniformity was measured off-line by standard methods using a Uster UT-3 device. The mass uniformity of the yarn was 10.21.

Yarn elongation and tenacity were measured off-line by standard methods using a Uster Tensojet device set to 500 breaks. The resultant properties were:

| | |
|---|---|
| Average elongation: | 6.51% |
| CV % of elongation: | 11.00% |
| Maximum elongation: | 8.44% |
| Minimum elongation: | 3.37% |
| Average tenacity: | 28.82 cN/tex |
| CV % of tenacity: | 30.42% |
| Maximum tenacity: | 54.17 cN/tex |
| Minimum tenacity: | 7.53 cN/tex |

The following controlled formulation was examined visually for difference in appearance and yarn structure. A 20" length of yarn was chosen at random and examined for the number of interlaced segments and the sizes of both the fasciated segments and the non-fasciated segments.

Control B

A sliver of staple fibers was created by drawing and stretch-breaking 3 ends of polyester microfiber POY of 255 denier and 200 fibers in each end. The POY was passed through a device with the following speed ratios:

Draw zone speed ratio 2:1

Stretch-break speed ratio 3:1

The incoming speed of the POY was 21.9 yards per minute.

The sliver was then directly fed into a yarn consolidation zone with a speed ratio of 0.80:1. Within the consolidation zone was one interlace jet of the type described in U.S. Pat. No. 6,052,878. The air pressure supplied to the jet was 110 psi.

The resultant consolidated yarn was 159 denier. The exit speed from the machine was 105 yards per minute.

In a 20 inch length of yarn there were 60 interlaced segments comprised primarily of parallel fibers fasciated with fibers wrapped in a perpendicular manner to the yarn axis. The fasciated yarn segments ranged in length from 1 mm to 17 mm. The non-fasciated segments ranged in length from 2 mm to 7 mm.

Where the subject matter of this invention is stated or described as comprising, including, containing or having certain components or characteristics, it is to be understood, unless the statement or description explicitly provides to the contrary, that one or more components or characteristics other than those explicitly stated or described may be present therein. In an alternative embodiment, however, the subject matter of this invention may be stated or described as consisting essentially of certain components or characteristics, in which embodiment components or characteristics that would materially alter the principle of operation or the distinguishing features of the invention are not present therein. In a further alternative embodiment, the subject matter of this invention may be stated or described as consisting of certain components or characteristics, in which embodiment components or characteristics other than impurities or incidental features are not present therein.

Where the indefinite article "a" or "an" is used with respect to a statement or description of the presence of a component or characteristic in the subject matter of this invention, it is to be understood, unless the statement or description explicitly provides to the contrary, that the use of such indefinite article does not limit the presence of the component or characteristic in the invention to one in number.

What is claimed is:

1. A method for spinning a yarn comprising (a) passing a sliver through a first torque jet that imparts rotation to the fibers of the sliver, and forms a partially consolidated yarn having false twist; (b) passing the partially consolidated yarn through an interlace jet to wrap a fiber around the surface of the partially consolidated yarn, retain therein the false twist, and form a consolidated yarn; and (c) passing the consolidated yarn through a second torque jet that has a direction of rotation that is the same as that of the first torque jet.

2. A method according to claim 1 wherein one or both of the torque jets have a forwarding air flow.

3. A method according to claim 1 further comprising a step of wetting the partially consolidated yarn prior to passing the partially consolidated yarn through the interlace jet.

4. A method according to claim 3 wherein the partially consolidated yarn is wetted with water.

5. A method according to claim 1 further comprising a step of incorporating continuous filaments into the yarn.

6. An apparatus for spinning a yarn from a sliver comprising (a) a first torque jet that forms the sliver into a partially consolidated yarn having a false twist and a plurality of longitudinally well-ordered bundles in which the fibers are substantially parallel; (b) an interlace jet that wraps a fiber around the surface of the partially consolidated yarn to retain the false twist therein; and (c) a second torque jet that has a direction of rotation that is the same as that of the first torque jet.

7. An apparatus according to claim 6 wherein one or both of the torque jets have a forwarding air flow.

8. An apparatus according to claim 6 further comprising a liquid applicator located before the interlace jet and either before or after a torque jet.

9. An apparatus according to claim 6 further comprising a stretch-break apparatus for making the sliver.

10. A yarn comprising a plurality of first and second segments wherein (a) each first segment comprises a longitudinally well-ordered bundle of discontinuous fibers that are in substantially parallel alignment, and the longitudinally well-ordered bundle is wrapped with at least one surface fiber that passes around the bundle with a frequency such tat the distance between turns of the wrapping fiber is less than about 30 times the largest dimension of the cross section of the wrapping fiber; (b) each second segment comprises a bundle of discontinuous fibers (i) that is not wrapped by a surface fiber, or is wrapped by a surface fiber that passes around the bundle with a frequency such that the distance between turns of the wrapping fiber is about 100 or more times the largest dimension of the cross section of the wrapping fiber, and (ii) in which 40% or less of the volume of the bundle is occupied by the fibers; and (c) in a length of the yarn, the lengths of the first segments added together comprise more than sixty percent of the length of yarn, and the lengths of the second segments added together comprise less than forty percent of the length of yarn.

11. A yarn according to claim 10 wherein either or both segments have protuding fiber ends.

12. A yarn according to claim 10 that comprises staple fibers.

13. A yarn according to claim 10 that further comprises continuous filaments.

14. A yarn according to claim 10 that is prepared from one or more materials selected from the group consisting of nylon, polyester, an aramid (a polymer derived for example from m- or p-phenylenediamine and terephthaloyl chloride), a fluoropolymer, an acetate polymer or copolymer, an acrylic polymer or copolymer, polyacetal, an acrylate polymer or copolymer, polyacrylonitrile, a cellulose polymer, an olefin polymer or copolymer (such as an ethylene or propylene polymer or copolymer), polyimide, a styrenic polymer or copolymer (including for example, styrene/acrylonitrile), an ether/ester copolymer, a copolymer of an amide with an ether and/or ester, a vinyl polymer such as poly(vinyl chloride) or poly(vinyl alcohol), and a polyimide.

15. A yarn according to claim 10 wherein, in a length of the yarn, the lengths of the first segments added together comprise more than eighty percent of the length of yarn, and the lengths of the second segments added together comprise less than twenty percent of the length of yarn.

* * * * *